US006743334B2

(12) United States Patent
Klerelid et al.

(10) Patent No.: US 6,743,334 B2
(45) Date of Patent: Jun. 1, 2004

(54) METHOD AND APPARATUS FOR MAKING A TISSUE PAPER WITH IMPROVED TACTILE QUALITIES WHILE IMPROVING THE REEL-UP PROCESS FOR A HIGH BULK WEB

(75) Inventors: Ingvar Berndt Erik Klerelid, Karlstad (SE); Lars-Erik Roland Önnerlöv, Karlstad (SE); Leif Sören Videgren, Karlstad (SE)

(73) Assignee: Metso Paper Karlstad Aktiebolag (AB), Karlstad (SE)

( * ) Notice: Subject to any disclaimer, the term of this patent is extended or adjusted under 35 U.S.C. 154(b) by 81 days.

(21) Appl. No.: 10/167,336

(22) Filed: Jun. 11, 2002

(65) Prior Publication Data

US 2003/0226279 A1 Dec. 11, 2003

(51) Int. Cl.[7] ..... D21F 5/00; D21F 5/18; D21F 9/00

(52) U.S. Cl. ..... 162/118; 162/359.1; 162/283; 162/205

(58) Field of Search ..... 162/118, 283, 162/359.1, 361; 34/114, 534, 132, 123, 71, 444; 242/160.1, 370

(56) References Cited

U.S. PATENT DOCUMENTS

| | | | | |
|---|---|---|---|---|
| 3,432,936 A | | 3/1969 | Cole et al. | |
| 3,549,098 A | | 12/1970 | Helkala et al. | |
| 3,807,056 A | | 4/1974 | Norfolk | |
| 5,399,412 A | | 3/1995 | Sudall et al. | |
| 5,501,309 A | | 3/1996 | Walth et al. | |
| 5,593,545 A | | 1/1997 | Rugowski et al. | |
| 5,614,293 A | * | 3/1997 | Krzysik et al. | 162/134 |
| 5,616,207 A | | 4/1997 | Sudall et al. | |
| 5,667,636 A | * | 9/1997 | Engel et al. | 162/117 |
| 5,746,887 A | * | 5/1998 | Wendt et al. | 162/109 |
| 5,779,860 A | | 7/1998 | Hollenberg et al. | |
| 6,077,398 A | * | 6/2000 | Fiscus et al. | 162/361 |
| 6,149,767 A | * | 11/2000 | Hermans et al. | 162/109 |
| 6,171,442 B1 | * | 1/2001 | Farrington et al. | 162/129 |
| 6,183,601 B1 | * | 2/2001 | Otto et al. | 162/205 |
| 6,311,921 B1 | | 11/2001 | Möller et al. | |
| 6,325,320 B1 | | 12/2001 | Möller et al. | |
| 6,488,816 B1 | * | 12/2002 | Klerelid | 162/359.1 |
| 6,551,461 B2 | * | 4/2003 | Hermans et al. | 162/207 |
| 6,558,514 B2 | * | 5/2003 | Rouhiainen et al. | 162/193 |
| 2002/0074684 A1 | * | 6/2002 | Baggot et al. | 264/132 |
| 2002/0139499 A1 | * | 10/2002 | Berglund et al. | 162/118 |
| 2002/0179269 A1 | * | 12/2002 | Klerelid | 162/206 |

FOREIGN PATENT DOCUMENTS

| | | |
|---|---|---|
| GB | 1389992 | 4/1975 |
| WO | WO 96/24718 A1 | 8/1996 |
| WO | WO 01/44568 A1 | 6/2001 |

* cited by examiner

*Primary Examiner*—José A. Fortuna
(74) *Attorney, Agent, or Firm*—Alston & Bird LLP

(57) ABSTRACT

A dry end section for a paper-making machine for producing a high-bulk tissue is provided. Such a machine comprises a through-air dryer adapted to finally dry a paper web and a through-air drying fabric configured to transport the web through the through-air dryer. A separating device is included for facilitating separation of the web from the through-air drying fabric. A reel is also provided and is configured to receive the web thereon. The web is received directly on the separating device or on a fabric wrapped about the separating device. In some instances, the web may be compressed between the separating device and an adjacent roll or by a web-compressing device disposed along the fabric transporting the web. The web is then transported to the reel directly from the fabric or other support mechanism extending between the separating device and the reel, without free draw of the web. Associated methods are also provided.

35 Claims, 7 Drawing Sheets

METHOD AND APPARATUS FOR MAKING A TISSUE PAPER WITH IMPROVED TACTILE QUALITIES WHILE IMPROVING THE REEL-UP PROCESS FOR A HIGH BULK WEB

BACKGROUND OF THE INVENTION

1. Field of the Invention

The present invention relates to paper-making machinery and, more particularly, to a paper-making machine and associated method for making a tissue paper with improved tactile qualities while improving the reel-up process.

2. Description of Related Art

In the production of tissue for use in personal hygiene products and the like, it is desired to produce a tissue with good tactile qualities (i.e., silky and soft to the touch) while also achieving a high machine speed and efficiency. The speed and efficiency are often limited by the performance of the dry end of the machine between the final dryer and the winding station or reel-up. Tissue is extremely delicate and difficult to handle, especially at high machine speeds. For example, in some instances, the tissue web is dried by a through air dryer ("TAD"), wherein a through air drying fabric ("TAD fabric") is used to transport the web through the TAD. The TAD fabric is generally an open structured drying fabric. Accordingly, the web will tend to become drawn into the structure of the TAD fabric as the web is processed through the TAD and other processing devices such as, for instance, a molding device, in order to produce a structured three-dimensional fiber network. However, separating the tissue web from the TAD fabric without damaging the web then becomes a difficult and sensitive task.

In addition, due to the generally delicate nature of the tissue web, excessive transfers and handling of the web in the dry end of the machine may result in damage to the web. Such detrimental results may also occur if the web is unsupported between components within the dry end. Further, if a bulky tissue web is produced in the paper-making process, the capacity of the roll on which the web is wound may be undesirably low since the web cannot be tightly wound onto the roll. A loosely wound roll is relatively more difficult to handle and may be undesirably prone to, for example, telescoping with respect to the roll.

Thus, there exists a need for a method and apparatus directed to a dry end of a tissue paper-making machine for making a tissue web providing improved tactile qualities while improving the handling of the tissue web in the dry end. Such an apparatus and method should desirably be capable of addressing the issue of separating the tissue web from a TAD fabric efficiently and at high speed, but without damage. Further, such an apparatus and method should provide for minimal transfers and other handling of the tissue web while providing support for the tissue web throughout the dry end. In addition, the apparatus and method should be directed to reducing the bulk of the tissue web, again with minimal handling and while providing the desired improved tactile quality, in order to increase roll capacity and facilitate handling of the rolls.

BRIEF SUMMARY OF THE INVENTION

The above and other needs are met by the present invention which, in one embodiment, provides a dry end section for a paper-making machine for producing a high-bulk tissue. Such a machine includes a through-air dryer adapted to finally dry a paper web and a through-air drying fabric configured to transport the web through the through-air dryer. A separating device is also included for facilitating separation of the web from the through-air drying fabric, and the machine comprises a reel configured to, receive the web. A single permeable fabric is wrapped about the separating device and extends to the reel, wherein the single permeable fabric is configured to receive the web directly thereon from the through-air drying fabric and to transport the web directly to the reel without free draw of the web.

Another advantageous aspect of the present invention comprises a dry end section for a paper-making machine for producing a high-bulk tissue. Such a machine includes a through-air dryer adapted to finally dry a paper web and a through-air drying fabric configured to transport the web through the through-air dryer. A separating device is further included for separating the web from the through-air drying fabric such that the web is received directly on the separating device. A roll is disposed adjacent to the separating device so as to define a nip therebetween and to form a web-compressing device. A single fabric is wrapped about the roll, passes through the nip, and extends to a reel configured to receive the web, wherein the single fabric is configured to receive the web thereon at the nip and to transport the web from the nip to the reel, at which point the web is transferred directly from the single fabric to a reel without free draw of the web.

Still another advantageous aspect of the present invention comprises a dry end section for a paper-making machine for producing a high-bulk tissue. Such a machine includes a through-air dryer adapted to finally dry a paper web and a through-air drying fabric configured to transport the web through the through-air dryer. A separating device is also included for separating the web from the through-air drying fabric, wherein the separating device is configured to receive the web directly thereon. A reel having a reel drum disposed adjacent thereto forms a reel-up for receiving the web from the separating device. A non-contacting support system is disposed between the separating device and the reel-up, wherein the non-contacting support system is configured to receive the web directly from the separating device and to transport the web directly to the reel-up.

Yet other advantageous aspects of the present invention comprise methods for making a tissue with enhanced tactile quality and facilitating reel-up of the tissue in a dry end of a tissue paper-making machine, each method corresponding to the processing of a tissue web with the respective dry end section for a paper-making machine for producing a high bulk tissue as described herein, as will be appreciated by one skilled in the art.

Thus, embodiments of the present invention provide a method and apparatus directed to a dry end of a tissue paper-making machine for making a tissue web providing improved tactile qualities while improving the handling of the tissue web in the dry end. Embodiments of the present invention further address the issue of separating the tissue web from a TAD fabric efficiently and at high speed, but without damage and while minimizing transfers and other handling of the tissue web, by using a suction roll for separating the web from the TAD fabric, wherein the suction roll is disposed adjacent to an additional roll to also form a web-compressing device. The web is then wound directly onto the roll or transported directly thereto by a single fabric passing through the web-compressing device. Accordingly, support is provided for the tissue web throughout the dry end, and runability of the dry end is facilitated, while the bulk of the tissue web is reduced in order to provide increased roll capacity and more efficient handling of the rolls. In addition to improving the tactile quality of the tissue web, embodiments of the present invention reduce the number of fabrics, and components associated therewith, used in the dry end, thereby simplifying the paper-making machine, reducing the handling of the web, and reducing the cost and maintenance requirements of the machine. Therefore, the present invention provides distinct advantages as further detailed herein.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

Figure 4:
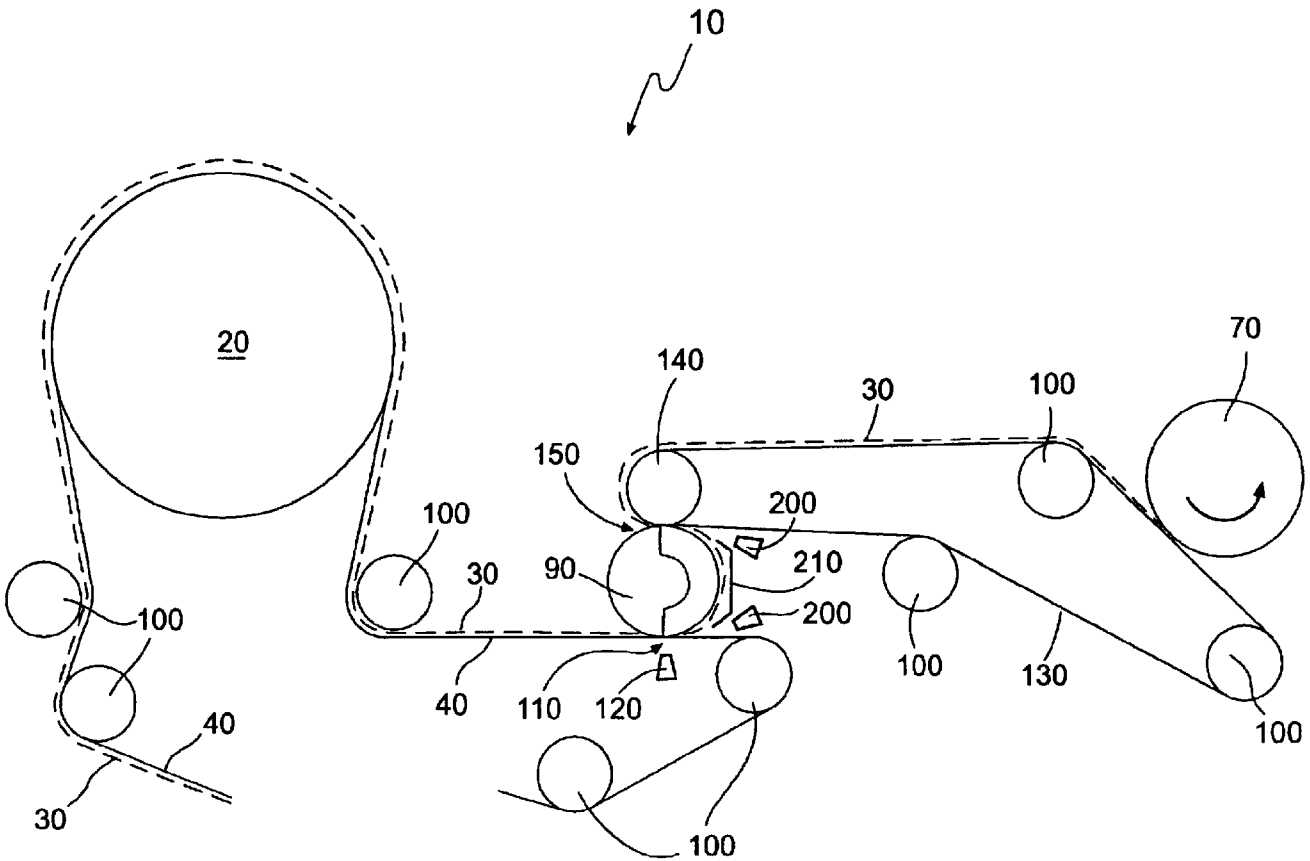
Figure 5:
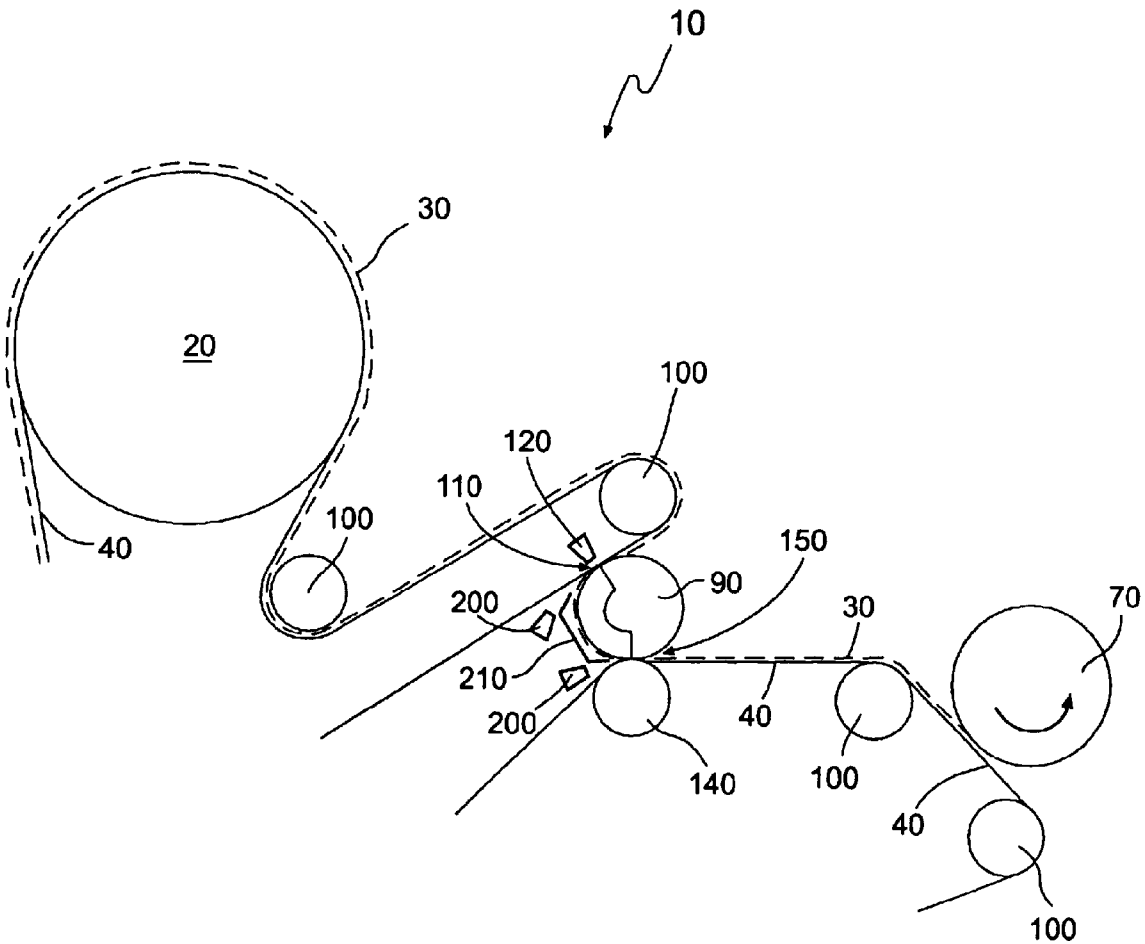
Figure 6:
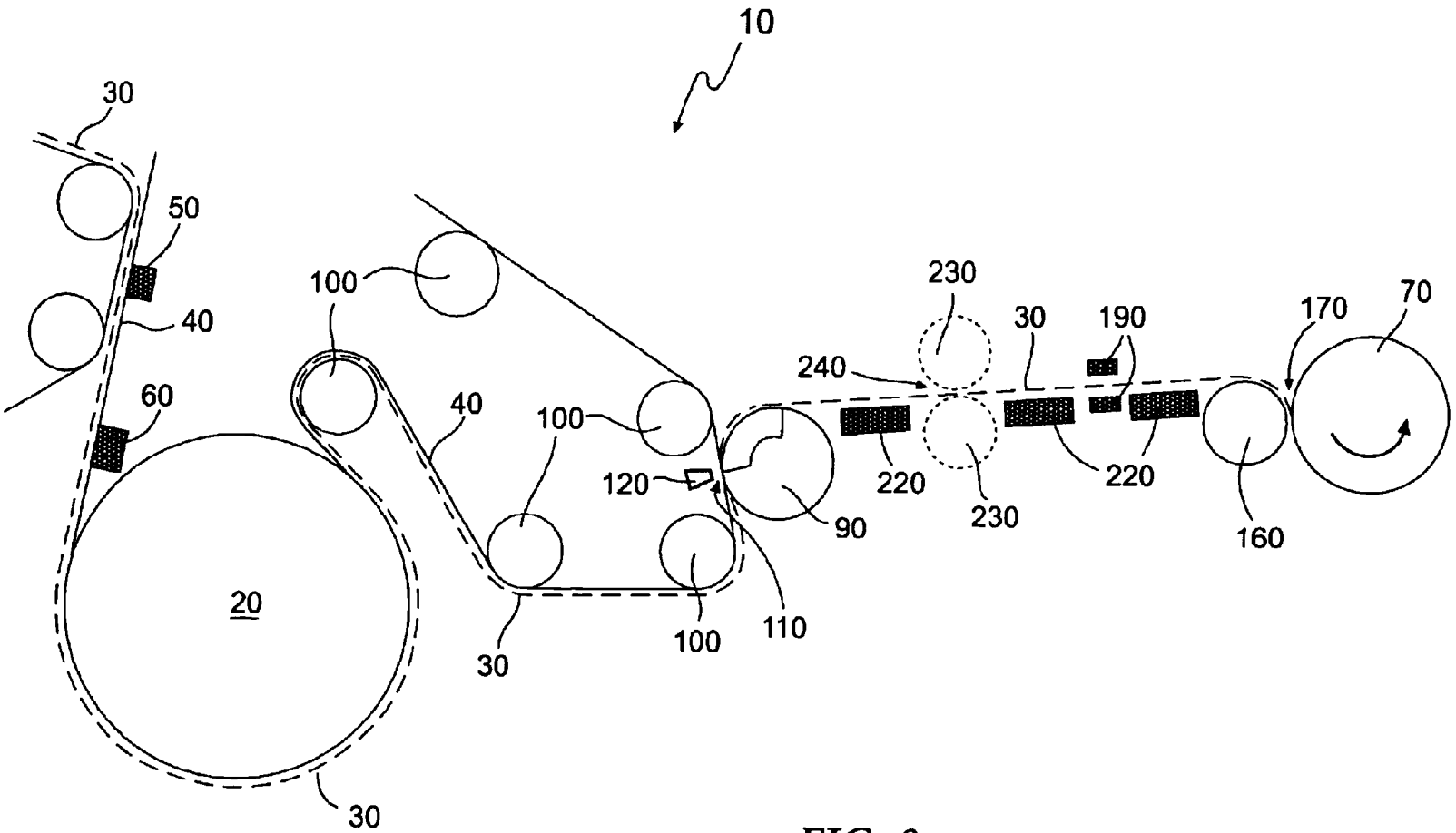

FIGS. 4 and 5 are cross-sectional schematics of still further alternate embodiments of the present invention, each showing a dry end section for a paper-making machine for producing a high-bulk tissue having a web-compressing device formed between a suction roll and an adjacent roll having a fabric wrapped thereabout; and FIG. 6 is a cross-sectional schematic of yet another alternate embodiment of the present invention showing a dry end section for a paper-making machine for producing a high-bulk tissue, the dry end section including an inward flow TAD and the web being transported between a suction roll and a reel nip by air devices.

DETAILED DESCRIPTION OF THE INVENTION

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

FIGS. 1A–B, 2, and 3 schematically illustrate embodiments of a dry end of a paper-making machine, the dry end being indicated by the numeral 10, according to the present invention. The dry end 10 includes at least one through air dryer ("TAD") 20 configured to finally dry a tissue paper web 30. Though the embodiments of the present invention are generally described herein in terms of a single TAD 20, the dry end 10 may include a plurality of through-air dryers. Further, one skilled in the art will appreciate that the web 30 may be pre-dried or otherwise processed through other dryers before being transferred to the TAD 20. For example, the web 30 may be pre-dried on a Yankee dryer (not shown) and then creped therefrom before being transferred to a TAD 20 for final drying. In other instances, the web 30 may be pre-dried by another type of dryer such as, for example, an impingement dryer (not shown). Thus, embodiments of the present invention describing a dry end 10 are not intended to be restrictive with respect to the processing of the web 30 prior to the web 30 being finally dried by the through air dryer 20.

Figure 1A:
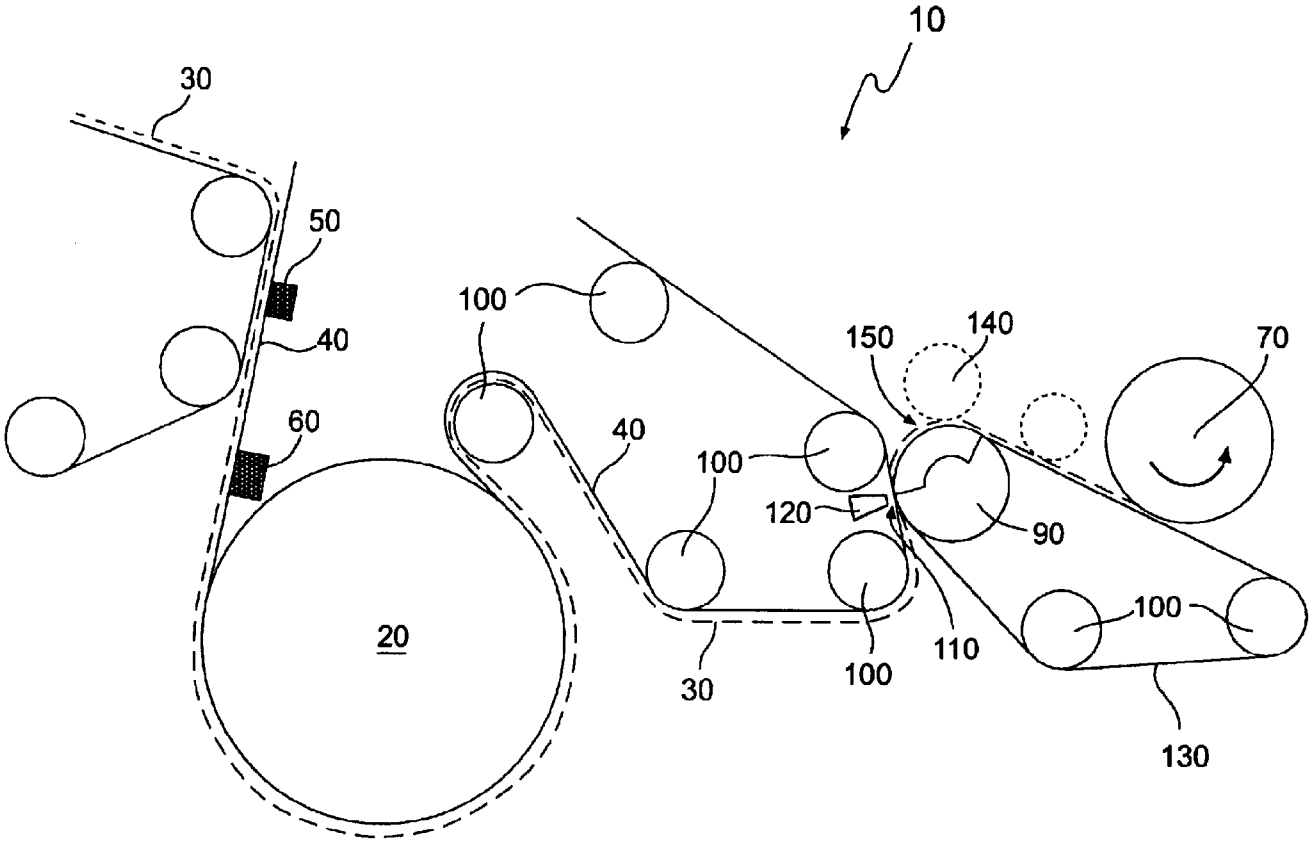
FIG. 1A is a cross-sectional schematic of a dry end section for a paper-making machine for producing a high-bulk tissue according to one embodiment of the present invention showing an inward flow TAD and a web-compressing device formed between a suction roll having a fabric wrapped thereabout and an adjacent roll.
Figure 1B:
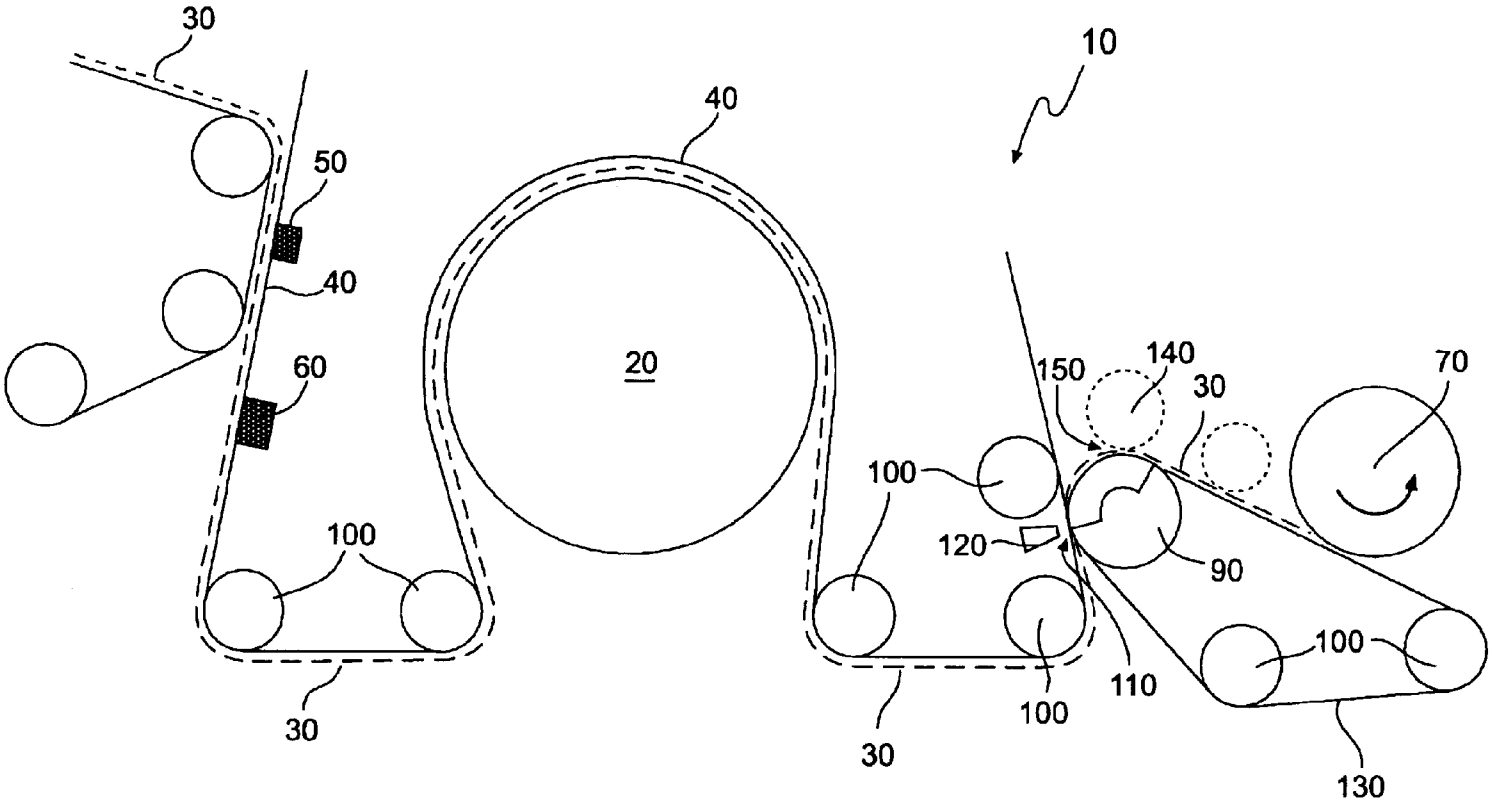
FIG. 1B is a cross-sectional schematic of a dry end section for a paper-making machine for producing a high-bulk tissue according to one embodiment of the present invention showing an outward flow TAD and a web-compressing device formed between a suction roll having a fabric wrapped thereabout and an adjacent roll.
Figure 2:
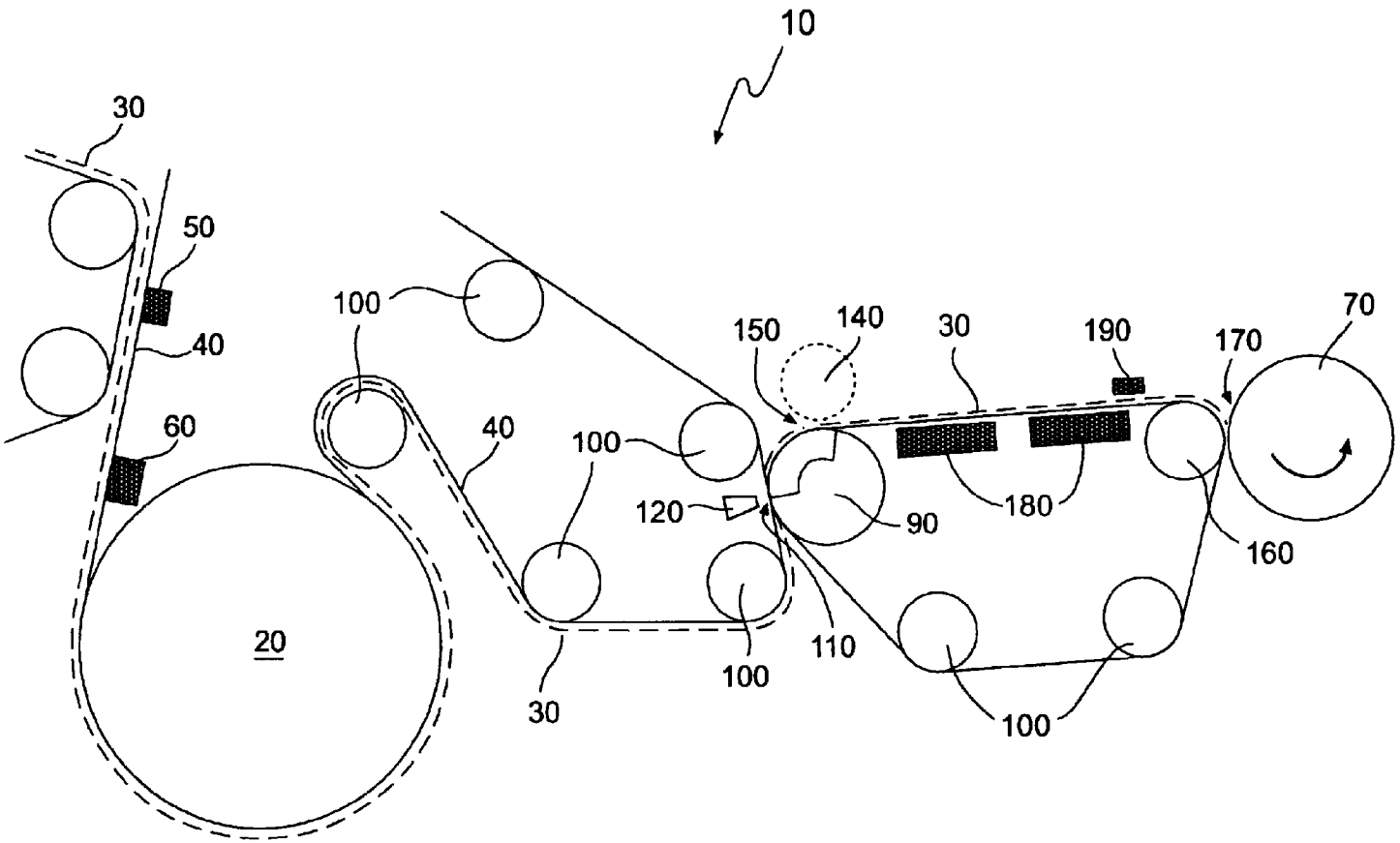
FIG. 2 is a cross-sectional schematic of a dry end section for a paper-making machine for producing a high-bulk tissue according to an alternate embodiment of the present invention showing an inward flow TAD and a web-compressing device formed between a suction roll having a fabric wrapped thereabout and an adjacent roll.
Figure 3:
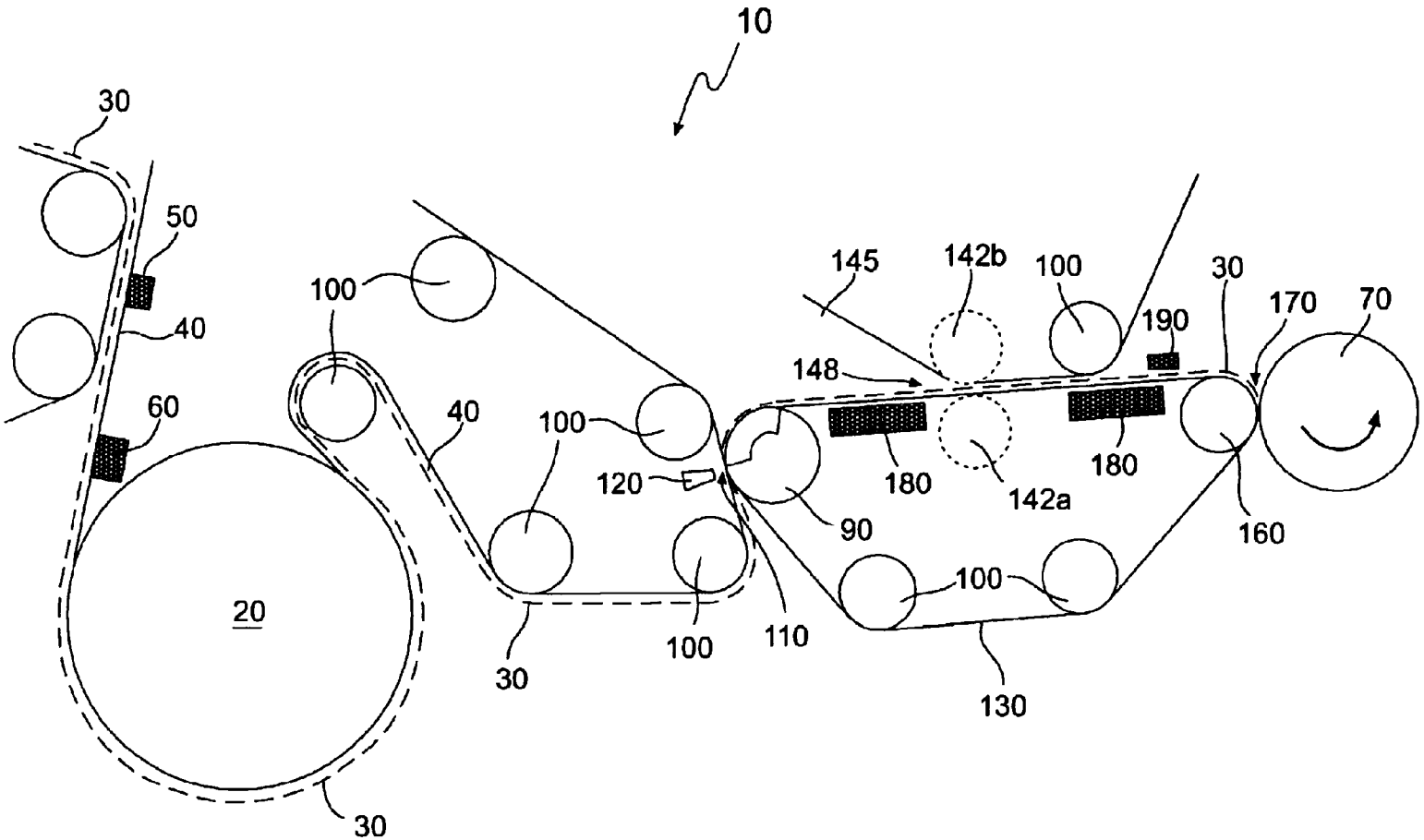
FIG. 3 is a cross-sectional schematic of a dry end section for a paper-making machine for producing a high-bulk tissue according to another alternate embodiment of the present invention showing a web-compressing device formed about the web along the dry end section between the suction roll and the reel.

As shown in FIGS. 1A, 2, and 3, the TAD 20 may be configured to have an inward flow or, in some instances, to have an outward flow if the drying air, as shown in FIG. 1B. Accordingly, one skilled in the art will appreciate that any of the embodiments described herein may implement either an inward flow TAD or an outward flow TAD within the spirit and scope of the present invention. As such, it will be understood that both TAD alternatives are expressly included herein for each embodiment of the present invention, even though both TAD alternatives may not be specifically mentioned or illustrated. The TAD 20 is further configured to have a through air drying fabric ("TAD fabric") 40 wrapped thereabout for receiving the web 30 thereon and transporting the web 30 through the TAD 20. In some cases, a transfer device 50 may be disposed adjacent to the TAD fabric 40 about where the web 30 is received in order to facilitate the transfer of the web 30 onto the TAD fabric 40. The TAD fabric 40 is generally an open structured drying fabric and the web 30 will tend to become drawn into the structure of the TAD fabric 40 as the web 30 is processed through the TAD 20 and other processing devices such as, for instance, a molding device 60 which, in one embodiment, is disposed before the TAD 20 and adjacent to the TAD fabric 40. Such a molding device 60 is configured to impart suction on the web 30 through the TAD fabric 40 so as to draw the web 30 into the fabric structure and form a structured three-dimensional fiber network. According to one embodiment of the present invention, the finally-dried web 30 has a basis weight of between about 10 $g/m^2$ and about 50 $g/m^2$ and a dry caliper of between about 0.2 mm and about 0.5 mm, and thus a density of between about 20 $kg/m^3$ and about 250 $kg/m^3$, after leaving the TAD 20.

A tissue web 30 is extremely delicate and difficult to handle, especially at high machine speeds. As such, following the drying process, it is typically difficult to separate the tissue web 30 from a TAD fabric 40 into which the web 30 has become drawn. Further, a tissue web 30 is at less risk of damage if handled by fewer machine components and is supported (i.e., not subjected to free draw) during the drying process. Thus, according to one advantageous aspect of the present invention, the web 30 is separated from the TAD fabric 40, following final drying of the web 30 by the TAD 20, by a separating device 90 having a permeable fabric 130 wrapped thereabout. The separating device 90 may comprise, for example, a suction-configured reel drum or a suction roll (referred to herein as "suction roll 90") for separating the web 30 from the TAD fabric 40. More particularly, the TAD fabric 40 is guided about the TAD 20 by a plurality of turning rolls 100. Following final drying of the web 30 by the TAD 20, the TAD fabric 40 is directed so as to run tangentially to the suction roll 90 so as to define a web transfer point 110 between the TAD fabric 40 and the permeable fabric 130. Thus, the suction roll 90 imparts suction through the permeable fabric 130, as discussed below, so as to facilitate the transfer of the web 30 thereto. Further, in order to facilitate the running of the web 30 through the described dry end 10 and separation of the web 30 from the TAD fabric 40, an air-emitting device 120 such as, for example, an air knife or an air shower, may be disposed adjacent to the TAD fabric 40 about the web transfer point 110. The air-emitting device 120 is directed/configured to emit air through the TAD fabric 40 and against the web 30 so as to provide assistance in separating the web 30 from the TAD fabric 40 only as the web 30 is initially being threaded through the dry end 10.

Accordingly, the leading edge of the web 30 is first separated from the TAD fabric 40 by the suction roll 90 in conjunction with the air-emitting device 120, wherein the permeable fabric 130 is configured to allow the suction roll 90 to apply the suction therethrough to the tissue web 30. Once the web 30 is separated from the TAD fabric 40, the web 30 is received directly on the permeable fabric 130 and the air-emitting device 120 is deactivated. The permeable fabric 130 then solely transports the web 30 from the suction roll 90 to the reel 70. That is, in advantageous embodiments of the present invention, only one permeable fabric 130 extends from the suction roll 90 to the reel 70 and only that permeable fabric 130 contacts and supports the web 30 therebetween. The web 30 is further transported from the TAD fabric 40 to the reel 70 without free draw. As such, once the web 30 is dried and separated from the TAD fabric 40, the web 30 is wound onto a reel 70 with minimal handling. More particularly, as shown in FIGS. 1A and 1B, the permeable fabric 130 wraps about the separating device 90 and about one or more turning rolls 100 such that the permeable fabric 130 runs adjacent to the reel 70 and tangentially thereto. In such a configuration, the permeable fabric 130 supports the reel 70 during the winding process, forming a "soft nip" therewith, wherein the pressure in the soft nip may be selectively controlled so as to control the tension in the web 30 as it is wound onto the reel 70.

In instances where a high bulk tissue web 30 is produced, such a web 30, for example, may lessen the capacity of a roll, may be more difficult to handle, and may be prone to telescoping on the roll. Accordingly, it may be advantageous to reduce the bulk of the web 30 prior to winding the web 30 onto the roll. Compressing the web 30 in order to reduce the bulk thereof is usually accomplished through the use of a compression device defining a compression nip between adjacent rolls. Such a compression device comprises, for example, a calender used in the manufacture of card stock. However, due to the fragile nature of the tissue web 30, it is very difficult to thread an unsupported tissue web through such a compression device. In addition, a calender used in the production of card stock is typically configured to impart smoothness or gloss to the card stock surface, which is not necessarily desired with a tissue paper. For a tissue paper, a good tactile quality, softness, and silkiness are some of the more desirable characteristics.

As shown in FIGS. 1A and 1B, a roll 140 may be added and disposed adjacent to the suction roll 90 so as to form a web-compressing device defining a nip 150 therebetween. Such a nip 150 may be adjustable to provide the necessary pressure for compressing the web 30, which, in one embodiment, is a linear load of between about 200 N/m and about 800 N/m that reduces the web 30 in thickness by about 20% to about 50% with respect to the pre-compressed thickness of the web 30. Since the web 30 is received directly on the permeable fabric 130 from the TAD fabric 40, the permeable fabric 130 supports and transports the web 30 through the nip 150. The roll 140 may be similar to a calender roll in that the surface thereof may be smooth. In the alternative, the surface of the roll 140 may also be patterned if a patterned structure is desired in the final web 30.

However, when the web 30 is transported through a nip, the tendency of the web 30 will be to follow the smoother surface upon exiting the nip. Thus, the separating device 90 may also be configured to facilitate running of the web 30. For example, the suction roll 90 may comprise a perforated outer shell or mantle with one or more air devices disposed inside the mantle and in spaced apart relation with respect thereto. Such air devices may be configured according to the needs of the particular application and, for example, may be adjustable within the mantle or rotatable about the axis of the suction roll 90 to further facilitate adjustment of the suction roll 90 for different processes. The air devices may further be configured to provide suction or to emit air outwardly therefrom, as necessary. As such, the mantle and the air devices may be arranged such that suction or emitted air can be selectively provided along the circumference of the mantle and/or laterally across the mantle while the mantle is rotating and transporting the web 30. For example, since it is desired to maintain the web 30 on the permeable fabric 130 through the nip 150 and to the reel 70, one or more air devices may be placed within the mantle of the suction roll 90 to provide suction along the circumference of the mantle from the web transfer point 110 to after the nip 150 so as to maintain the web 30 on the permeable fabric 130 therebetween.

In some situations, the necessary suction through the mantle of the suction roll 90, and the permeable fabric 130, may vary depending on the position of the web 30 with respect thereto. For example, suction is required about the web transfer point 110 to separate the web 30 from the TAD fabric 40 and to transfer the web 30 to the permeable fabric 130. However, a higher suction may be initially required when the leading edge of a new web 30 is to be separated from the TAD fabric 40, wherein the air-emitting device 120 may be simultaneously activated to facilitate the initial transfer of the web 30 to the permeable fabric 130. In one embodiment, such a higher suction may be on the order of, for example, 30 kPa. After the initial threading of the web 30, a lesser suction may be required to maintain the web 30 on the suction roll 90 and the permeable fabric 130, from the web transfer point 110 and through the reel nip 150. In one embodiment, such a lesser suction maybe on the order of, for example, 5–10 kPa. Still further, in some instances, the air devices may be configured with respect to the mantle so as to provide suction or air emission across the entire width, or at one or more selected zones across the width of the mantle, the selected zones thereby providing the necessary characteristic for the corresponding segment of the mantle while, for example, reducing the required volume capacity of the air devices. Accordingly, the air devices may be appropriately and selectively controlled to provide the necessary conditions for the web 30 about the mantle of the suction roll 90.

As shown in FIG. 2, a reel drum 160 may disposed adjacent to the reel 70 so as to form a reel nip 170 therebetween. In this manner, the reel drum 160 supports the reel 70 and thus comprises an alternate configuration for facilitating the winding the web 30 onto the reel 70. A single permeable fabric 130 extends about the suction roll 90, the reel drum 160, and one or more turning rolls 100 such that only the single permeable fabric 130 transports the web 30 from the suction roll 90 to the reel 70 without free draw of the web 30. That is, the single permeable fabric 130 extends about the suction roll 90 and cooperates therewith to separate the web 30 from the TAD fabric 40. The permeable fabric 130 then receives the web 30 directly thereon and supports and transports the web 30 through the nip 150 of the web-compressing device formed between the suction roll 90 and the adjacent roll 140. The suction roll 90 is further configured to provide suction along the mantle thereof from the web transfer point 110 to after the nip 150 for maintaining the web 30 on the permeable fabric 130 through the nip 150. Following the nip 150, one or more air devices 180 may be disposed adjacent to the permeable fabric 130 so as to facilitate runability. More particularly, the air device(s) 180 may be configured so as to retain the web 30 on the permeable fabric 130 as a new web 30 is being threaded into the dry end 10. The air device(s) 180 may comprise, for example, a blowing device, such as a blow box, capable of creating a low pressure effect for retaining the web 30 on the permeable fabric 130. In addition, one or more measuring devices 190 such as, for example, a scanner, may be disposed adjacent to the web 30, opposite to the permeable fabric 130, for measuring web properties such as, for instance, the thickness thereof, wherein such measurement devices 190 will be known and appreciated by one skilled in the art. The web 30 is then directed through the reel nip 170 and wound onto the reel 70.

FIG. 3 illustrates an alternative embodiment to the embodiment shown in FIG. 2. As shown, instead of having a roll 140 disposed adjacent to the suction roll 90, a web-compressing arrangement may be provided. The web-compressing arrangement includes a first roll 142*a* disposed within the loop of the permeable fabric 130 opposite to the web 30, wherein the first roll 142*a* is disposed between the suction roll 90 and the reel 70. A second roll 142*b* having a press fabric 145 wrapped thereabout is disposed in opposing relation to the first roll 142*a* so as to form a nip 148 therebetween. The nip 148 is further formed such that the web 30 and the permeable fabric 130 pass therethrough, whereby the web 30 is compressed between the permeable fabric 130 and the press fabric 145. Such a nip 148 may also be adjustable to provide the necessary pressure for compressing the web 30 to reduce the thickness thereof to the desired thickness.

Thus, the embodiments shown in FIGS. 1A–B, 2, and 3 provide a compact dry end 10, wherein the separating device 90 serves to separate the web 30 from the TAD fabric 40 while also serving as one of the rolls in a web-compressing device. Such a dry end 10 further allows the web 30 to be transferred from the TAD fabric 40 to the reel 70 without free draw. Minimal components forming the dry end 10 further provides a paper-making machine with a smaller footprint and also minimizes the necessary handling of the web 30. In addition, the configuration of the suction roll 90 with a separate mantle and one or more air devices disposed therein allows the mantle to be selectively segmented into variable suction and variable air emission zones, while enabling, for example, a common suction roll 90 having a diameter of about 1000 mm to about 1400 mm to be used, thereby conserving costs with respect to the machine. The described embodiments thus contribute to provide improved runability of the web 30 without free draw so as to provide an improved dry end 10 for a paper-making machine.

FIGS. 4 and 5 illustrate further advantageous embodiments of the present invention. As shown, the suction roll 90 is configured to separate the web 30 from the TAD fabric 40 and to receive the web 30 directly thereon. The roll 140 is disposed adjacent to the suction roll 90 so as to form the web-compressing device, the rolls 90, 140 defining the nip 150 therebetween. One skilled in the art will appreciate, however, that, in some instances, a turning roll 100 about which the TAD fabric 40 is wrapped may be disposed adjacent to the suction roll 90 so as to form a second nip as part of a double nip web-compressing device (not shown), wherein that turning roll 100 may, in some situations, be configured as an air-emitting device so as to facilitate the transfer of the web 30 to the suction roll 90 following the second nip. Following the nip 150, the single fabric 130 is wrapped about the roll 140 and extends about one or more turning rolls 100 to support the reel 70 for winding the web 30 thereon. Accordingly, the web 30 is received directly on the suction roll 90, wherein the suction roll 90 then transports the web 30 into the nip 150. At the nip 150, the web 30 is transferred to the fabric 130, which thereafter supports and transports the web 30 to the reel 70 such that the web 30 is transported from the TAD fabric 40 to the reel 70 without free draw thereof. In order to retain the web 30 on the suction roll 90 between the web transfer point 110 and the nip 150, the suction roll 90 may be configured to provide suction about the portion of the mantle extending therebetween, as previously described. Further, according to various embodiments of the present invention, the roll 140 may be configured for suction as described herein and the single fabric 130 may thus be permeable or, in the alternative, the roll 140 may be a solid roll and the single fabric 130 may be smooth and impermeable.

Though the suction from the suction roll 90 is intended to facilitate the transportation of the web 30 through the dry end 10, separation of the web 30 from the TAD fabric 40 and transfer of the web 30 to the suction roll 90, as well as direction of the web 30 into the nip 150, may be further assisted by one or more blower devices 200 such as, for example, an air knife. More particularly, one air knife 200 may be directed toward the web transfer point 110 on the downstream side thereof to facilitate transfer of the web 30 onto the suction roll 90, while another air knife 200 may be directed toward the nip 150 from the upstream side thereof in order to direct the web 30 into the nip 150. In addition, in order to further concentrate the air streams emitted by the respective air knives 200, as well as to protect the web 30 from the air streams, a suitably shaped screen 210 may be disposed between the portion of the suction roll 90 carrying the web 30 and the air knives 200.

FIG. 6 illustrates another alternate embodiment, wherein the suction roll 90 is disposed adjacent to the TAD fabric 40 so as to separate the web 30 therefrom, wherein the web 30 is transferred directly onto the suction roll 90. A reel drum 160 is disposed adjacent to the reel 70 so as to form a reel nip 170 therebetween. The web 30 is supported and transported between the suction roll 90 and the reel nip 170 by a non-contacting support system 220 comprising, for example, one or more air foils, wherein such air foils may be active or passive. The air foils 220 are configured and spaced so as to provide sufficient support for the web 30 until the web 30 is transferred onto the reel drum 160 and directed into the reel nip 170. Such a configuration may be particularly advantageous, for example, for a dry end section 10 for a stronger tissue paper web 30 such as, for instance, for forming an industrial tissue or towel. Further, embodiments of the present invention implementing a non-contacting support system 220 allows a measurement device 190, such as a scanner, to be disposed about either or both surfaces of the web 30 for measuring the desired web properties. In addition, in some embodiments, a web-compressing device may be implemented for compressing the web 30. Such a web-compressing device comprises a pair of rolls 230 disposed in opposing relation about the web 30, the rolls 230 defining a nip 240 with the web 30 passing through the nip 240. In this manner, the web 30 is compression treated on both surfaces thereof. If the configuration shown in FIG. 6 is appropriate for the desired paper-making process, then the elimination of a fabric between the suction roll 90 and the reel nip 170, as well as the elimination of components associated with such a fabric, may result in significant cost savings.

According to one advantageous aspect of the present invention, in instances where the web 30 is processed through a web-compressing device, such as a nip having a linear load of between about 200 N/m and about 800 N/m, the dry caliper of the web 30 is reduced by between about 20% and about 50%. More particularly, the dry caliper of the web 30 is reduced to between about 0.15 mm and about 0.4 mm, such that the web 30 has a post-compression density of between about 25 kg/m$^3$ and about 333.3 kg/m$^3$.

Many modifications and other embodiments of the invention will come to mind to one skilled in the art to which this invention pertains having the benefit of the teachings presented in the foregoing descriptions and the associated drawings. For example, the web-compressing device described in various embodiments of the present invention may be configured to form either a hard or a soft nip between the rolls comprising the device, wherein the rolls may be at ambient temperature or heated. For a soft nip web-compressing device, one of the rolls may have a cover comprised of a resilient material such as, for example, rubber. Further, a heated web-compressing device may be advantageous in achieving a more consistent thickness profile across the width of the web. In addition, one skilled in the art will appreciate that the present disclosure describes and otherwise supports methods associated with embodiments of the present invention such as, for instance, methods for making a tissue with enhanced tactile quality and facilitating reel-up of the tissue in a dry end of a tissue paper-making machine, as described and claimed herein. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A dry end section for a paper-making machine for producing a high-bulk tissue, said machine comprising:

a through-air dryer adapted to finally dry a paper web;

a through-air drying fabric configured to transport the web through the through-air dryer;

a separating device for facilitating separation of the web from the through-air drying fabric;

a reel configured to receive the web; and a single permeable fabric wrapped about the separating device and extending to the reel, the single permeable fabric being configured to receive the web directly thereon from the through-air drying fabric and to transport the web directly to the reel without free draw of the web.

2. A dry end section according to claim 1 further comprising a roll disposed adjacent to the separating device so as to define a nip therebetween, the nip having the single permeable fabric passing therethrough, and to form a web-compressing device configured to compress the web before winding the web onto the reel.

3. A dry end section according to claim 1 wherein the single permeable fabric is configured to support the reel so as to facilitate winding of the web onto the reel.

4. A dry end section according to claim 1 further comprising a reel drum disposed adjacent to the reel so as to form a reel nip therebetween with the single permeable fabric transporting the web through the reel nip, the reel drum being configured to support the reel so as to facilitate winding of the web onto the reel.

5. A dry end section according to claim 1 wherein the separating device is selected from the group consisting of a suction-configured reel drum and a suction roll.

6. A dry end section according to claim 1 wherein the separating device comprises a roll having a perforated mantle and a suction device disposed within the mantle in spaced apart relation with respect thereto, the suction device being configured to selectively provide a suction zone about the mantle.

7. A dry end section according to claim 6 wherein the suction device is adjustably disposed within the mantle.

8. A dry end section according to claim 6 wherein the mantle defines an axis and the suction device is disposed within the mantle so as to be rotatable about the axis.

9. A dry end section according to claim 1 wherein the separating device is configured to provide an adjustable suction for separating the web from the through-air drying fabric.

10. A dry end section according to claim 1 further comprising an air emission arrangement disposed adjacent to the separating device and configured to facilitate separation of the web from the through-air drying fabric.

11. A dry end section according to claim 1 further comprising a web-compressing device disposed between the separating device and the reel, the web-compressing device comprising a first roll disposed adjacent to the single permeable fabric opposite to the web, the web-compressing device further comprising a second roll having a press fabric wrapped thereabout, the second roll opposing the first roll so as to form a nip therebetween such that the press fabric extends through the nip, the single permeable fabric being configured to transport the web through the nip such that the web is compressed between the single permeable fabric and the press fabric before the web is received by the reel.

12. A dry end section for a paper-making machine for producing a high-bulk tissue, said machine comprising:

a through-air dryer adapted to finally dry a paper web;

a through-air drying fabric configured to transport the web through the through-air dryer;

a separating device for separating the web from the through-air drying fabric, the separating device being further configured to receive the web directly thereon;

a roll disposed adjacent to the separating device so as to define a nip therebetween and to form a web-compressing device;

a reel configured to receive the web; and a single fabric configured to wrap about the roll, to pass through the nip, and to extend to the reel, the single fabric being configured to receive the web thereon at the nip and to transport the web from the nip to the reel, the web being transferred directly from the single fabric to the reel without free draw of the web.

13. A dry end section according to claim 12 wherein the separating device is selected from the group consisting of a suction-configured reel drum and a suction roll.

14. A dry end section according to claim 12 wherein the separating device comprises a roll having a perforated mantle and a suction device disposed within the mantle in spaced apart relation with respect thereto, the suction device being configured to selectively provide a suction zone about the mantle.

15. A dry end section according to claim 14 wherein the suction device is adjustably disposed within the mantle.

16. A dry end section according to claim 14 wherein the mantle defines an axis and the suction device is disposed within the mantle so as to be rotatable about the axis.

17. A dry end section according to claim 14 wherein the separating device is configured to provide an adjustable suction for separating the web from the through-air drying fabric.

18. A dry end section according to claim 14 further comprising an air emission arrangement disposed adjacent to the separating device and configured to facilitate separation of the web from the through-air drying fabric.

19. A dry end section according to claim 14 wherein the roll is a suction roll and the single fabric is a permeable fabric.

20. A dry end section according to claim 14 wherein the roll is a solid roll and the single fabric is at least one of a smooth fabric and an impermeable fabric.

21. A method for making a tissue with enhanced tactile quality and facilitating reel-up of the tissue in a dry end of a tissue paper-making machine, said method comprising:

finally drying a tissue web on a through-air drying fabric with a through air dryer;

separating the tissue web from the through-air drying fabric with a separating device having a single permeable fabric wrapped thereabout such that the tissue web is received directly on the single permeable fabric;

transporting the tissue web to a reel with the single permeable fabric; and winding the tissue web onto the reel, the tissue web being received on the reel directly from the single permeable fabric without free draw of the tissue web.

22. A method according to claim 21 wherein separating the tissue web from the through-air drying fabric further comprises separating the tissue web from the through-air drying fabric with a separating device, selected from the group consisting of a suction-configured reel drum and a suction roll, having a single permeable fabric wrapped thereabout.

23. A method according to claim 21 further comprising directing the tissue web and the single permeable fabric through a web-compressing device, the web-compressing device having a nip formed between the separating device and a roll disposed adjacent thereto, prior to winding the tissue web onto the reel.

24. A method according to claim 21 wherein separating the tissue web from the through-air drying fabric further comprises separating the tissue web from the through-air drying fabric with a separating device configured to apply suction to the tissue web through the single permeable fabric.

25. A method according to claim 24 wherein separating the tissue web from the through-air drying fabric with a separating device configured to apply suction to the tissue web through the single permeable fabric further comprises applying a greater suction to the tissue web when the tissue web is first separated from the through-air drying fabric and then applying a lesser suction to the tissue web thereafter.

26. A method for making a tissue with enhanced tactile quality and facilitating reel-up of the tissue in a dry end of a tissue paper-making machine, said method comprising:

finally drying a tissue web on a through-air drying fabric with a through air dryer;

separating the tissue web from the through-air drying fabric with a separating device such that the tissue web is received directly on the separating device;

directing the tissue web through a web-compressing device having a nip formed between the separating device and a roll disposed adjacent thereto, the roll having a single fabric wrapped thereabout such that the tissue web is received on the single fabric at the nip;

transporting the tissue web to a reel with the single fabric; and winding the tissue web on the reel, the tissue web being received on the reel directly from the single fabric without free draw of the tissue web.

27. A method according to claim 26 wherein separating the tissue web from the through-air drying fabric further comprises separating the tissue web from the through-air drying fabric with a separating device selected from the group consisting of a suction-configured reel drum and a suction roll.

28. A method according to claim 26 wherein separating the tissue web from the through-air drying fabric further comprises separating the tissue web from the through-air drying fabric with a separating device configured to apply suction to the tissue web.

29. A method according to claim 28 wherein separating the tissue web from the through-air drying fabric with a separating device configured to apply suction to the tissue web further comprises applying a greater suction to the tissue web when the tissue web is first separated from the through-air drying fabric and then applying a lesser suction to the tissue web thereafter.

30. A method of making a tissue with enhanced tactile quality and facilitating reel-up of the tissue in a dry end of a tissue paper-making machine, said method comprising:

finally drying a tissue web, having a basis weight of between about 10 $g/m^2$ and about 50 $g/m^2$, on a through-air drying fabric with a through air dryer, the web having a dry caliper of between about 0.2 mm and about 0.5 mm and, therefore, a density of between about 20 $kg/m^3$ and about 250 $kg/m^3$;

separating the tissue web from the through-air drying fabric with a separating device having a single permeable fabric wrapped thereabout such that the tissue web is received directly on the single permeable fabric;

transporting the tissue web to a reel with the single permeable fabric; and winding the tissue web onto the reel, the tissue web being received on the reel directly from the single permeable fabric without free draw of the tissue web.

31. A method according to claim 30 further comprising directing the tissue web and the single permeable fabric through a web-compressing device, the web-compressing device having a nip formed between the separating device and a roll disposed adjacent thereto and configured to reduce the dry caliper of the web by between about 20% and about 50%, prior to winding the tissue web onto the reel.

32. A method according to claim 30 further comprising directing the tissue web and the single permeable fabric through a web-compressing device, the web-compressing device having a nip formed between the separating device and a roll disposed adjacent thereto and configured to reduce the dry caliper of the web to between about 0.15 mm and about 0.4 mm, so as to provide a post-compression density of between about 25 kg/m$^3$ and about 333.3 kg/m$^3$, prior to winding the tissue web onto the reel.

33. A method for making a tissue with enhanced tactile quality and facilitating reel-up of the tissue in a dry end of a tissue paper-making machine, said method comprising:

finally drying a tissue web, having a basis weight of between about 10 g/m$^2$ and about 50 g/m$^2$, on a through-air drying fabric with a through air dryer, the web having a dry caliper of between about 0.2 mm and about 0.5 mm and, therefore, a density of between about 20 kg/m$^3$ and about 250 kg/M$^3$;

separating the tissue web from the through-air drying fabric with a separating device such that the tissue web is received directly on the separating device;

directing the tissue web through a web-compressing device having a nip formed between the separating device and a roll disposed adjacent thereto, the roll having a single fabric wrapped thereabout such that the tissue web is received on the single fabric at the nip;

transporting the tissue web to a reel with the single fabric; and winding the tissue web on the reel, the tissue web being received on the reel directly from the single fabric without free draw of the tissue web.

34. A method according to claim 33 wherein directing the tissue web through a web-compressing device further comprises directing the tissue web through a web-compressing device so as to reduce the dry caliper of the web by between about 20% and about 50% prior to winding the tissue web onto the reel.

35. A method according to claim 33 wherein directing the tissue web through a web-compressing device further comprises directing the tissue web through a web-compressing device so as to reduce the dry caliper of the web to between about 0.15 mm and about 0.4 mm, so as to provide a post-compression density of between about 25 kg/m$^3$ and about 333.3 kg/m$^3$, prior to winding the tissue web onto the reel.

* * * * *